US006381767B1

(12) United States Patent
Brashears

(10) Patent No.: US 6,381,767 B1
(45) Date of Patent: May 7, 2002

(54) SWIMMING POOL COVER SUPPORT

(76) Inventor: Francis L. Brashears, 607 Salem Ave., Hagerstown, MD (US) 21740

( * ) Notice: Subject to any disclaimer, the term of this patent is extended or adjusted under 35 U.S.C. 154(b) by 0 days.

(21) Appl. No.: 09/891,539

(22) Filed: Jun. 27, 2001

(51) Int. Cl.[7] ..... E04H 4/08
(52) U.S. Cl. ..... 4/498; 4/503; 135/124; 135/128; 135/135
(58) Field of Search ..... 4/498, 503; 135/124, 135/128, 135

(56) References Cited

U.S. PATENT DOCUMENTS 2,964,759 A * 12/1960 Riggs ..... 4/498
3,534,412 A * 10/1970 Crook ..... 4/503
3,683,427 A * 8/1972 Burkholz et al. ..... 4/503
4,136,408 A * 1/1979 Dahlbeck et al. ..... 4/498
4,257,132 A * 3/1981 Kerby ..... 4/503
5,371,907 A 12/1994 Horvath
5,450,635 A 9/1995 Coffey
5,687,432 A 11/1997 Genzel

* cited by examiner

*Primary Examiner*—Charles R. Eloshway
(74) *Attorney, Agent, or Firm*—Stephen R. Greiner

(57) ABSTRACT

A swimming pool cover support having: a central hub, a number of knockdown arms radiating from the central hub, and a number of mounting brackets each being respectively secured to one of the knockdown arms.

3 Claims, 2 Drawing Sheets

SWIMMING POOL COVER SUPPORT

FIELD OF THE INVENTION

The present invention relates generally to accessories for swimming pools and, more particularly, to coverings therefor.

BACKGROUND OF THE INVENTION

Cleaning swimming pools has always been an unpleasant and time-consuming chore, the task being made worse by neglect during winter months. Debris floating atop a pool is usually skimmed with a net mounted at the end of a pole. Material submerged at the bottom is best handled with a suction device. Of course, an adequate cover can greatly reduce the effort required to fetch unwanted debris such as leaves and tree branches from a swimming pool.

Over time, many cover designs have been proposed for swimming pools. Some include rigid frames that suspend a tarpaulin over water. Unfortunately, these designs have permitted the tarpaulins to sag and collect precipitation and debris and sometimes fail under load. Others of these designs have been cumbersome, complex and costly in their construction providing only limited commercial success in the marketplace.

SUMMARY OF THE INVENTION

In light of the problems associated with the known swimming pool covers, it is a principal object of the invention to provide a support of uncomplicated construction that will suspend a tarpaulin or other sheet-like cover over a swimming pool. The cover, being suspended like the outer skin of a dome, will not sag substantially and will shed precipitation and debris throughout the period of its use.

It is another object of the invention to provide a support of the type described that can be easily assembled or disassembled by one person with minimal instruction and without tools.

It is an object of the invention to provide improved elements and arrangements thereof in a swimming pool cover support for the purposes described which is lightweight in construction, inexpensive to manufacture, and dependable in use.

Briefly, the swimming pool cover support in accordance with this invention achieves the intended objects by featuring a central hub and a plurality of knockdown arms radiating from the central hub. A special mounting bracket is secured to the outer end of each of the knockdown arms. Each of the mounting brackets has a pair of angularly joined fingers, one of which is inserted into the outer end of a knockdown arm and the other one of which is suspended beneath said outer end. The shank of a hook extends downwardly from the suspended bracket finger and terminates at an arcuate portion opening toward the junction of the bracket fingers.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
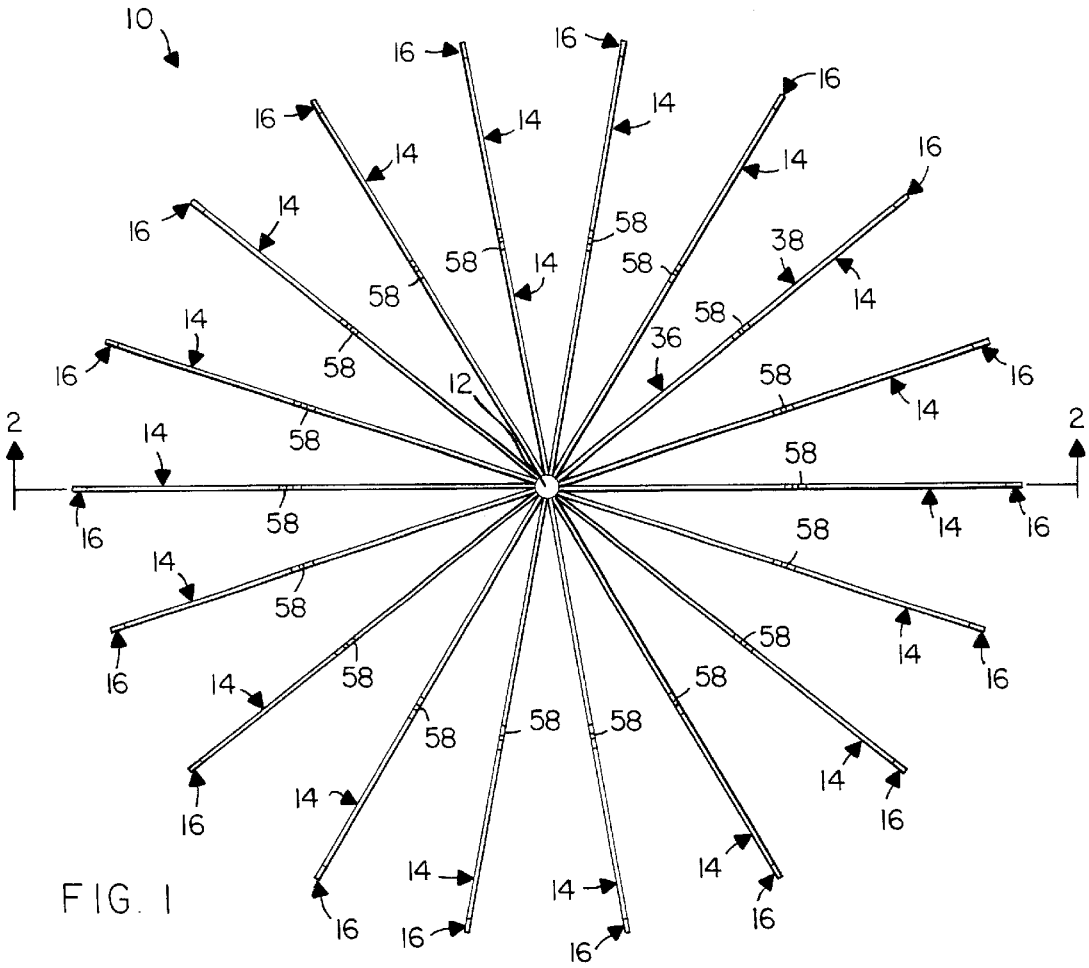
FIG. 1 is a top view of a swimming pool cover support in accordance with the present invention.
Figure 2:
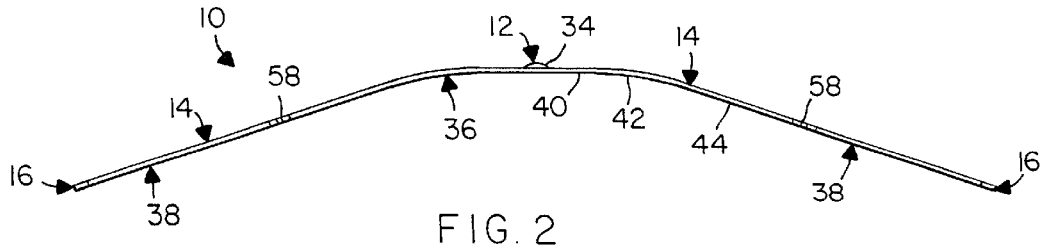
FIG. 2 is a lateral view of the swimming pool cover support taken along line 2—2 of FIG. 1.
Figure 3:
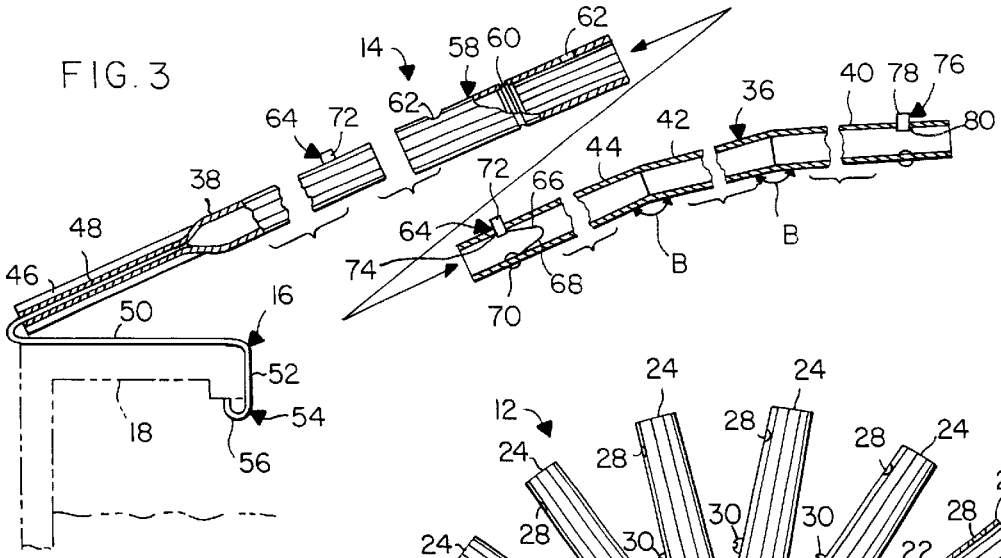
FIG. 3 is a cross-sectional view of one of the arms of the swimming pool cover with portions broken away to reveal details thereof.
Figure 4:
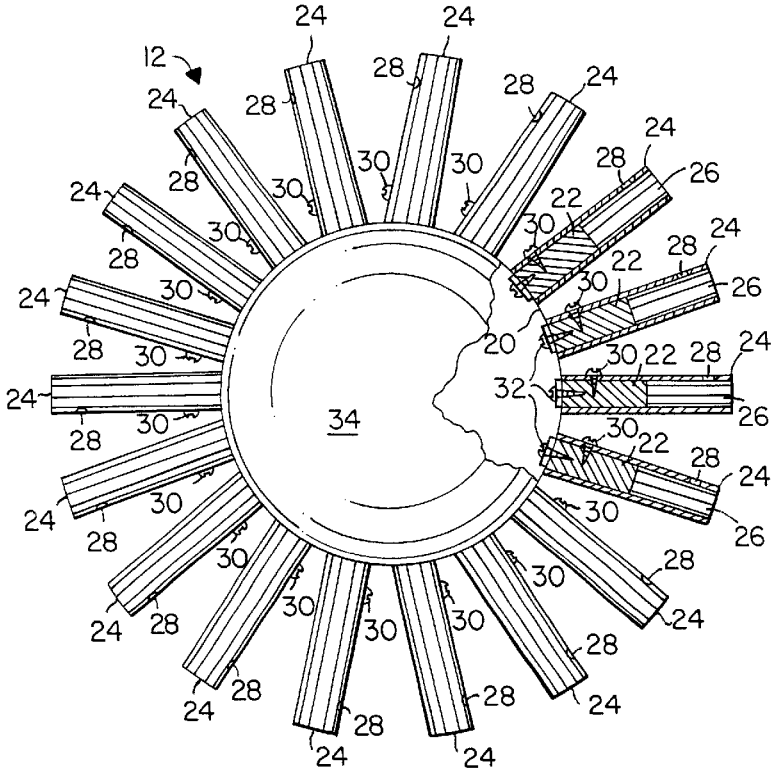
FIG. 4 is a top view of the hub of the swimming pool cover with portions broken away.
Figure 5:
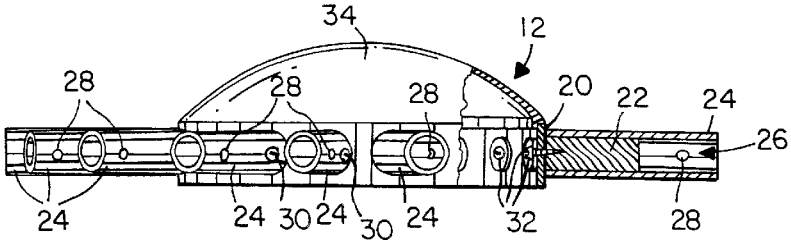
FIG. 5 is a side view of the hub of the swimming pool cover with portions broken away.

Referring now to the FIGS., a swimming pool cover support in accordance with the present invention is shown at 10. Support 10 includes a central hub 12 from which a plurality of knockdown arms 14 radiate. The outer ends of arms 14 are each provided with a mounting bracket 16 for grasping the top rail 18 of a swimming pool. In use, a tarpaulin (not shown) is positioned over support 10 to prevent precipitation and unwanted materials from entering a swimming pool.

Hub 12 has a ring 20 from which a plurality of retaining rods 22 extend outwardly. Fitted over each of rods 22 is a tubular sleeve 24 defining a socket 26 into which the inner end of one of the arms 14 may be inserted. An aperture 28 in each sleeve 24 provides access to each socket 26. Threaded fasteners 30 and 32 secure both sleeves 24 to rods 22 and rods 22 to ring 20. A domed cap 34 is fitted atop ring 20 to close and reinforce such.

Each arm 14 includes an inner member 36 and an outer member 38. Each inner member 36 is provided with a pair of spaced-apart bends B of about 170° dividing such into inner, middle, and outer segments 40, 42 and 44 and giving inner member 36 a configuration resembling a shallow, inverted "U". In contrast, each outer member 38 is straight along its length but has a crimped, outer end 46 for snugly receiving one bracket 16.

Each mounting bracket 16 has a pair of fingers 48 and 50 joined together at an acute angle. Finger 48 is normally inserted into one outer end 46 thus suspending finger 50 beneath outer member 38. Extending downwardly from finger 50 is the shank 52 of a retaining hook 54. Each shank 52 terminates in an arcuate portion 56 at its lower end. Each arcuate portion 56 opens toward the junction of fingers 48 and 50 and is adapted to engage the bottom of pool rail 18.

Inner and outer members 36 and 38 are joined together by a plurality of attachment sleeves 58. Each of the sleeves 58 is a rigid tube with a diameter sufficient to receive, respectively, the outer end of one inner member 36 and the inner end of one outer member 38. A narrowed neck 60 midway between the ends of each sleeve keeps the inner and outer members 36 and 38 from penetrating more than a predetermined distance into sleeves 58. Each of the sleeves 58 is provided with a pair of apertures 62 being located on opposite sides of neck 60 and giving access to the interior of sleeve 58.

Positioned within the inner end of each inner member 36 and within the outer end of each outer member 38 is a catch 64 formed from a strip of spring metal. Each catch 64 includes a pair of angularly joined arms 66 and 68 for engaging the opposite, interior surfaces of members 36 and 38. A pop rivet 70 secures each arm 68 to a member 36 or 38. Each arm 66, on the other hand, is provided with a projection 72 adapted to slide within, and extend through, an aperture 74 in member 36 or 38. When alignment of apertures 74 and 62 is obtained by inserting members 36 and 38 into sleeves 58, projections 72 snap into apertures 62 in sleeves 58 thereby releasably joining members 36 and 38 together.

Within the inner end of each inner member 36 is a catch 76 identical to catch 64 and having a projection 78 adapted to slide within, and extend through, an aperture 80 in the inner member 36. When an aperture 80 is aligned with an aperture 28 in a sleeve 24, a projection 78 snaps into aperture 28 thereby releasably joining an inner member 36 to hub 12.

Use of the support 10 is straightforward. With support 10 in an initially collapsed position, each inner member 36 is first joined by a sleeve 58 to an outer member 38 with catches 64 locking such together. Next, fingers 46 of brackets 16 are inserted into ends 46 of outer members 38, friction retaining such in place. Then, the inner ends of inner members 36 are inserted into sleeves 24 and rotated until catches 76 lock such in place. (It is of note that the relative positioning of apertures 80 and 28 ensures that each inner member 36 retained in a vertical plane for use. Similarly, the positioning of apertures 62 and 74 maintains brackets 16 vertically oriented.) The assembled support 10 being lightweight is lifted atop a swimming pool with fingers 50 resting upon top rail 18. The arcuate portions 56 of hooks 54 are now engaged with the bottom of rail 18 thereby securing support 10 in place atop the pool. Finally, a tarpaulin is positioned over support 10 to fully cover the pool.

While the invention has been described with a high degree of particularity, it will be appreciated by those skilled in the art that modifications may be made thereto. For example, the number and location of arms 14 as well as their relative lengths may be varied as a matter of design choice. Therefore, it is to be understood that the present invention is not limited to the sole embodiment described above, but encompasses any and all embodiments within the scope of the following claims.

I claim:

1. A swimming pool cover support, comprising:

a central hub including:

a ring having inner and outer surfaces;

a plurality of tubular sleeves secured to the outer surface of said ring and extending radially outward therefrom, each of said sleeves defining a socket; and, a domed cap positioned atop said ring;

a plurality of knockdown arms inserted into said sockets, radiating from said central hub and terminating at outer ends, each of said knockdown arms being of substantially equal length and having a plurality of separable members joined together by a plurality of spring metal catches; and, a plurality of mounting brackets each being respectively secured to one of said outer ends of said knockdown arms, each of said brackets including:

a pair of angularly joined fingers, one of which being inserted into one of said outer ends and the other one of which being suspended beneath said outer end; and, a hook having a shank extending vertically downward from said suspended finger and terminating at an arcuate portion opening toward the junction of said fingers.

2. The swimming pool cover support according to claim 1 wherein each arm includes:

an inner member having a pair of spaced-apart bends along the length thereof dividing said inner member into a plurality of angularly oriented segments configured as an inverted "U";

an attachment sleeve releasably secured to said inner member by one of said spring metal catches; and, an outer member releasably attached to said attachment sleeve by another one of said spring metal catches, said outer member being substantially straight along its length and having a crimped, outer end for snugly receiving one said bracket.

3. A swimming pool cover support, comprising:

a central hub having a plurality of tubular sleeves extending outwardly therefrom;

a plurality of knockdown arms radiating from said hub, each of said arms having an inner end positioned within a respective one of said tubular sleeves and an outer end remote therefrom, each arm including:

an inner member having a pair of spaced-apart bends along the length thereof dividing such dividing said inner member into a plurality of angularly oriented segments configured as an inverted "U";

an attachment sleeve releasably secured to said inner member by one of said spring metal catches; and, an outer member releasably attached to said attachment sleeve by another one of said spring metal catches, said outer member being substantially straight along its length and having a crimped, outer end; and, a plurality of mounting brackets each being respectively received by one of said outer ends of said knockdown arms, each of said brackets including:

a pair of angularly joined fingers, one of which being inserted into one of said outer ends and the other one of which being suspended beneath said outer end; and, a hook having a shank extending vertically downward from said suspended finger and terminating at an arcuate portion opening toward the junction of said fingers.

* * * * *